US011731442B2

(12) United States Patent
Nakazawa

(10) Patent No.: US 11,731,442 B2
(45) Date of Patent: Aug. 22, 2023

(54) DISCHARGE UNIT AND LIQUID DISCHARGE APPARATUS WITH ROTATION CONTROL

(71) Applicant: Yuuya Nakazawa, Kanagawa (JP)

(72) Inventor: Yuuya Nakazawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 6 days.

(21) Appl. No.: 17/524,753

(22) Filed: Nov. 12, 2021

(65) Prior Publication Data

US 2022/0153044 A1 May 19, 2022

(30) Foreign Application Priority Data

Nov. 16, 2020 (JP) ..... 2020-190584

(51) Int. Cl.

| | |
|---|---|
| ***B41J 25/304*** | (2006.01) |
| ***B41J 2/21*** | (2006.01) |
| ***B41J 25/34*** | (2006.01) |
| ***B41J 25/316*** | (2006.01) |
| *B41J 25/00* | (2006.01) |

(52) U.S. Cl.

CPC ..... *B41J 25/304* (2013.01); *B41J 2/2146* (2013.01); *B41J 25/316* (2013.01); *B41J 25/34* (2013.01); *B41J 2025/008* (2013.01)

(58) Field of Classification Search

CPC ..... B41J 25/304; B41J 2/2146; B41J 25/316; B41J 25/34; B41J 2025/008

See application file for complete search history.

(56) References Cited

U.S. PATENT DOCUMENTS

| | | | | |
|---|---|---|---|---|
| 2011/0187793 | A1* | 8/2011 | Ishii | B41J 2/145 29/890.1 |
| 2011/0187794 | A1 | 8/2011 | Ishii et al. | |
| 2013/0286066 | A1* | 10/2013 | Wanibe | B41J 2/145 347/8 |
| 2018/0311983 | A1* | 11/2018 | Saiga | B41J 25/001 |
| 2020/0139732 | A1* | 5/2020 | Naruse | B41J 25/304 |
| 2021/0260899 | A1 | 8/2021 | Tobita et al. | |

FOREIGN PATENT DOCUMENTS

| | | |
|---|---|---|
| JP | S53-30228 A | 3/1978 |
| JP | 2011-156812 | 8/2011 |
| JP | 2011-230315 | 11/2011 |
| JP | 2017-132075 | 8/2017 |

OTHER PUBLICATIONS

Extended European Search Report dated Mar. 24, 2022 in European Patent Application No. 21205779.8, 9 pages.

* cited by examiner

*Primary Examiner* — Henok D Legesse
(74) *Attorney, Agent, or Firm* — Xsensus LLP

(57) ABSTRACT

A discharge unit includes a head configured to discharge a liquid, a head mount to which the head is detachably attachable, and a holder configured to hold the head mount. The head mount includes multiple rotation mechanisms on multiple places of the head mount in a longitudinal direction of the head mount, and the holder is configured to rotatably and independently hold the multiple places of the head mount with the rotation mechanisms.

12 Claims, 10 Drawing Sheets

DISCHARGE UNIT AND LIQUID DISCHARGE APPARATUS WITH ROTATION CONTROL

CROSS-REFERENCE TO RELATED APPLICATION

This patent application is based on and claims priority pursuant to 35 U.S.C. § 119(a) to Japanese Patent Application No. 2020-190584, filed on Nov. 16, 2020, in the Japan Patent Office, the entire disclosures of which is hereby incorporated by reference herein.

BACKGROUND

Technical Field

Aspect of this disclosure relates to a discharge unit and a liquid discharge apparatus.

Related Art

A liquid discharge apparatus such as a printer includes a discharge unit in which multiple heads are arrayed and attach to a head mount. The discharge unit is also referred to as a discharge device, a head array, a head module, or the like.

The discharge unit has a configuration in which an inclination angle of the discharge unit is adjustable to adjust gaps between liquid discharge surfaces of heads respectively attached to multiple head mounts and a drum.

SUMMARY

In an aspect of this disclosure, a discharge unit includes a head configured to discharge a liquid, a head mount to which the head is detachably attached, and a holder holding the head mount. The head mount includes multiple rotation mechanisms on respective multiple portions of the head mount in a longitudinal direction of the head mount, and the holder rotatably and independently holds the multiple portions of the head mount with the respective rotation mechanisms.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
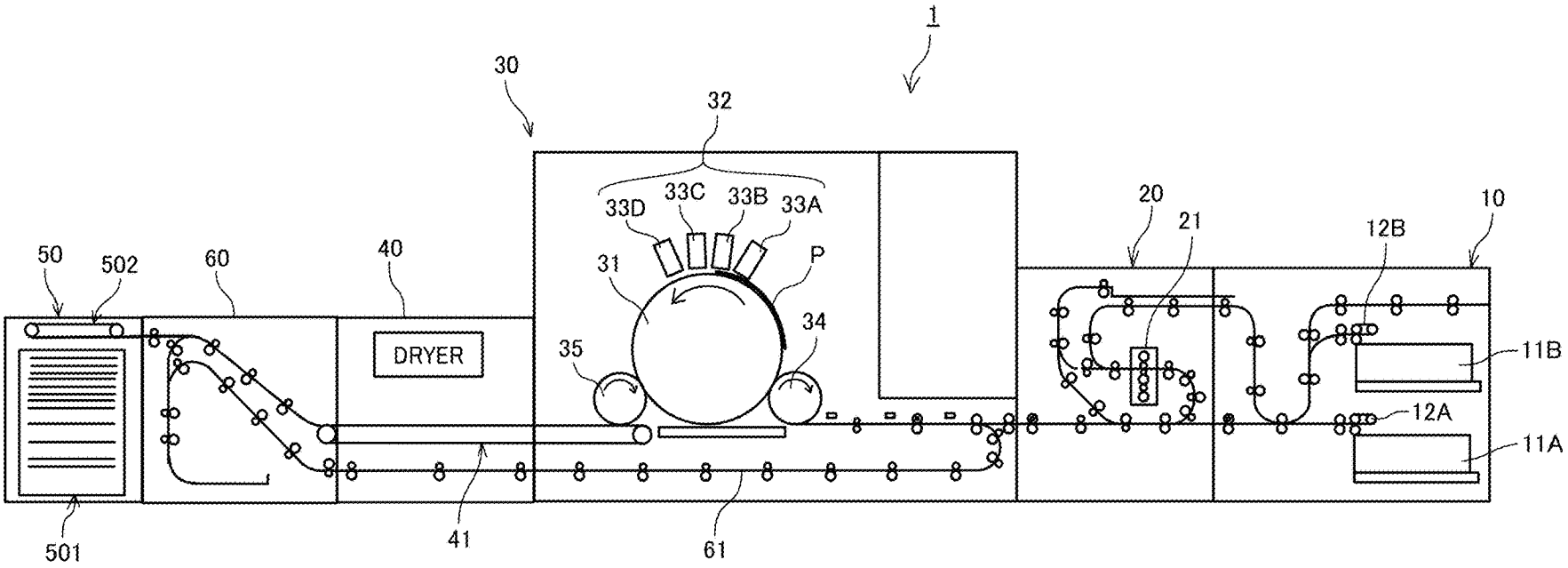
FIG. 1 is a schematic cross-sectional side view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below. First, a printer 1 as a liquid discharge apparatus according to a first embodiment of the present disclosure is described with reference to FIG. 1.

FIG. 1 is a schematic cross-sectional side view of the printer 1 according to the first embodiment of the present disclosure.

A printer 1 according to the first embodiment includes a loading unit 10 to load a sheet P into the printer 1, a pretreatment unit 20, a printing unit 30, a dryer 40, and an ejection unit 50, and a reverse mechanism 60. The sheet P is an application target (print target) to which a liquid is to be applied.

In the printer 1, the pretreatment unit 20 applies, as desired, a pretreatment liquid onto the sheet P fed (supplied) from the loading unit 10, the printing unit 30 applies liquid to the sheet P to perform desired printing, the dryer 40 dries the liquid adhering to the sheet P, and the sheet P is ejected to the ejection unit 50. The pretreatment unit 20 serves as a "pretreatment device".

The loading unit 10 includes loading trays 11 (a lower loading tray 11A and an upper loading tray 11B) to accommodate a plurality of sheets P and feeding units 12 (a feeding unit 12A and a feeding unit 12B) to separate and feed the sheets P one by one from the loading trays 11 and supply the sheets P to the pretreatment unit 20.

The pretreatment unit 20 includes, e.g., a coater 21 as a treatment-liquid application unit that coats a printing surface of the sheet P with a treatment liquid having an action and an effect of aggregation of colorant of ink to prevent bleed-through.

The printing unit 30 includes a drum 31 and a liquid discharge device 32. The drum 31 is a bearer (rotating member) that bears the sheet P on a circumferential surface of the drum 31 and rotates. The liquid discharge device 32 discharges a liquid toward the sheet P borne on the drum 31.

The printing unit 30 further includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the dryer 40.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes a plurality of suction holes dispersed on a surface of the drum 31, and a suction unit generates suction airflows directed from desired suction holes of the drum 31 to an interior of the drum 31.

The sheet gripper of the drum 31 grips the leading end of the sheet P forwarded from the transfer cylinder 34 to the drum 31, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) as liquid dischargers to discharge liquids. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K), respectively. Further, a discharge unit 33 may discharge a special liquid, that is, a liquid of spot color such as white, gold, or silver.

The printer 1 controls a discharge operation of each of the discharge units 33 of the liquid discharge device 32 by a drive signal corresponding to print data. When the sheet P borne on the drum 31 passes through a region facing the liquid discharge device 32, the liquids of respective colors are discharged from the discharge units 33, and an image corresponding to the print data is formed on the sheet P.

The drum 31 forwards the sheet P onto which a liquid has been applied by the liquid discharge device 32 to the transfer cylinder 35. The transfer cylinder 35 forwards the sheet P fed from the drum 31 to a conveyor 41. The conveyor 41 conveys the sheet P to the dryer 40 (heater).

The dryer 40 dries a liquid adhered (applied) onto the sheet P by the printing unit 30. Thus, a liquid component such as moisture in the liquid evaporates, and the colorant contained in the liquid is fixed on the sheet P. Additionally, curling of the sheet P is restrained.

The reverse mechanism 60 reverses, in switchback manner, the sheet P that has passed through the dryer 40 in double-sided printing. The reversed sheet P is fed back to an upstream side of the transfer cylinder 34 through a conveyance passage 61 of the printing unit 30.

The ejection unit 50 includes an ejection tray 51 and a sheet conveyor 502. A plurality of sheets P is stacked on the ejection unit 50. The plurality of sheets P conveyed through the reverse mechanism 60 is sequentially stacked and held on a stack part 501.

The discharge unit 33 according to the first embodiment of the present disclosure is described with reference to FIGS. 2 to 4.

Figure 2:
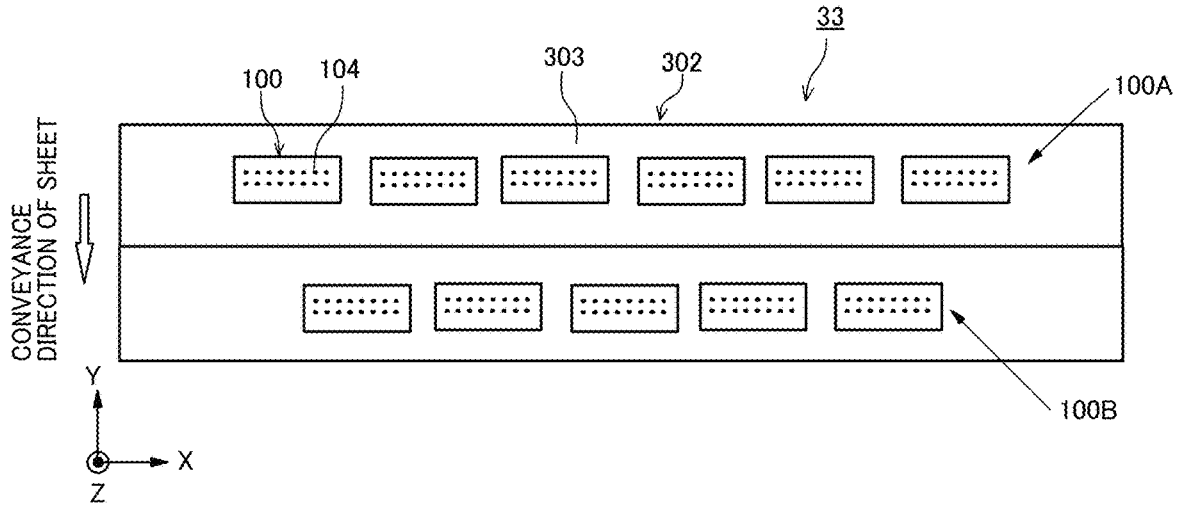
FIG. 2 is a plan view of a discharge unit according to the first embodiment viewed from a nozzle surface side of the discharge unit.

FIG. 2 is a plan view of the discharge unit 33 viewed from a nozzle surface side of the discharge unit 200.

Figure 3:
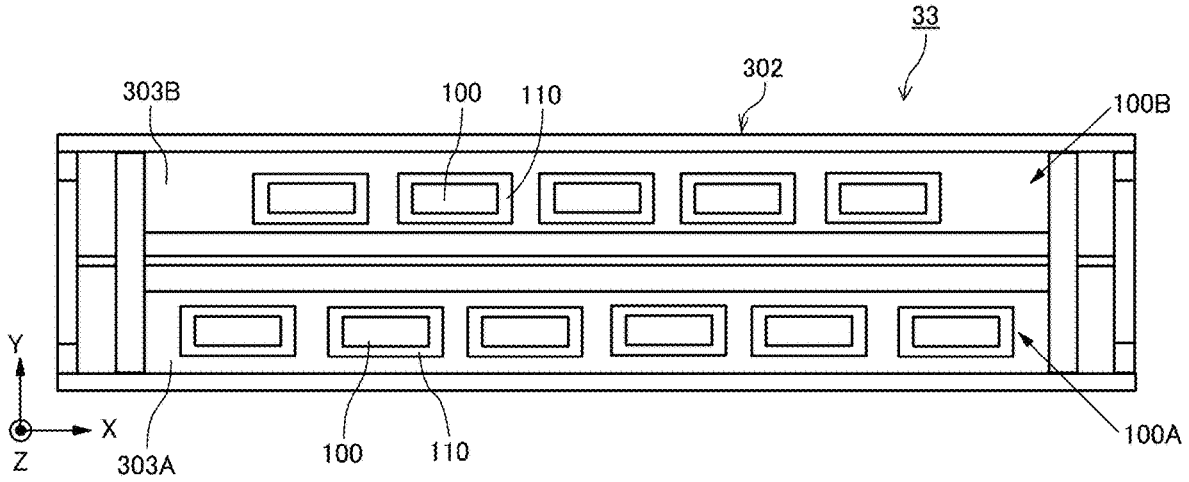
FIG. 3 is a plan view of the discharge unit viewed from a side opposite to the nozzle surface side of the discharge unit.

FIG. 3 is a plan view of the discharge unit 33 viewed from a side opposite to the nozzle surface side of the discharge unit 33.

Figure 4:
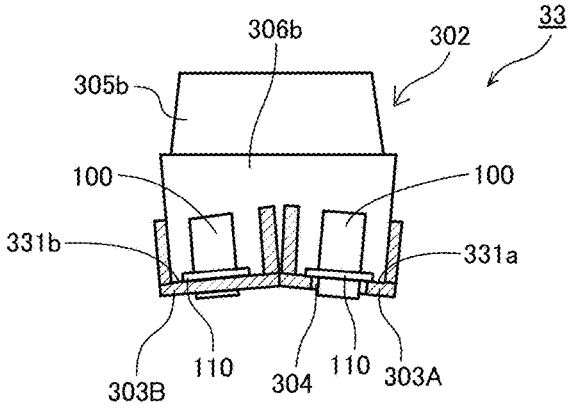
FIG. 4 is a cross-sectional side view of the discharge unit along a line A-A of FIG. 5.
Figure 5:
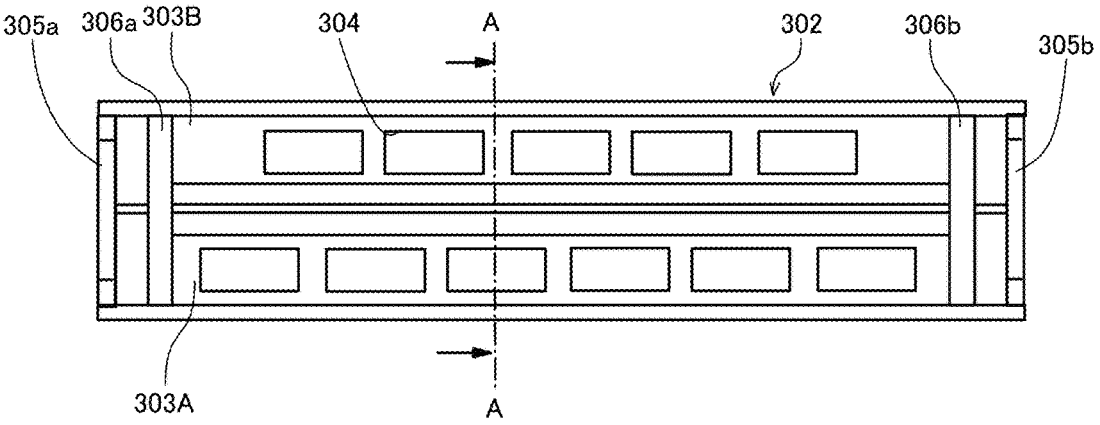
FIG. 5 is a schematic plan view of a head mount.

FIG. 4 is a cross-sectional side view of the discharge unit 33 along a line A-A of FIG. 5.

The discharge unit 33 includes a plurality of heads 100 to discharge a liquid. The heads 100 are arrayed in a staggered manner on a head mount 302. The head mount 302 serves as a mounting member to mount the heads 100. One of a row of the heads 100 (lower row in FIG. 3) arrayed in staggered manner is referred to as a head row 100A, and another row of the heads 100 (upper row in FIG. 3) is referred to as a head row 100B.

Thus, the multiple heads 100 (head row 100A and head row 100B) are attached to the head mount 302 in a transverse direction (Y-direction in FIG. 3) orthogonal to the longitudinal direction (X-direction in FIG. 3) of the head mount 302.

Each of the heads 100 includes multiple nozzle arrays. The multiple nozzles 104 are arrayed in the multiple nozzle arrays. A liquid is dischargeable from each of the multiple nozzles. A number of nozzle arrays is not limited to two as illustrated in FIG. 2 and may be any number. As illustrated in FIGS. 3 and 4, the head 100 includes a flange 110 that faces the base 303 (303A and 303B) that configures the head mount 302 in a direction perpendicular to a surface of the base 303 (in a Z-direction indicated in FIG. 3).

The heads 100 are inserted into the openings 304 of the base 303 to be attached to the base 303.

Next, a configuration of the head mount 302 is described with reference to FIGS. 5 to 8.

FIG. 5 is a schematic plan view of the head mount 302.

Figure 6:
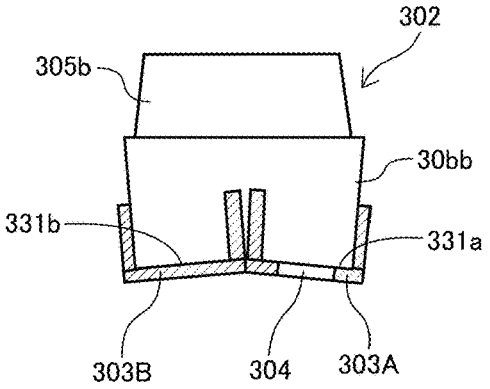
FIG. 6 is a cross-sectional front side view of the head mount along a line A-A of FIG. 5.

FIG. 6 is a cross-sectional front side view of the head mount 302 along a line A-A of FIG. 5.

Figure 7:
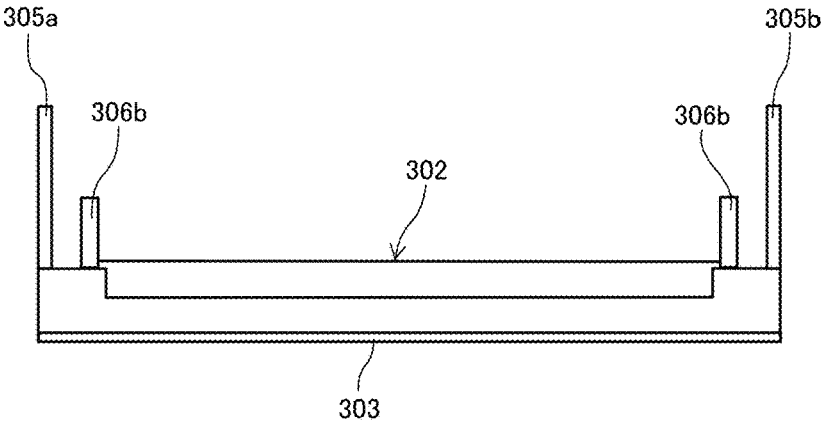
FIG. 7 is a schematic cross-sectional front view of the head mount of FIG. 5.

FIG. 7 is a schematic cross-sectional front view of the head mount 302 of FIG. 5.

Figure 8:
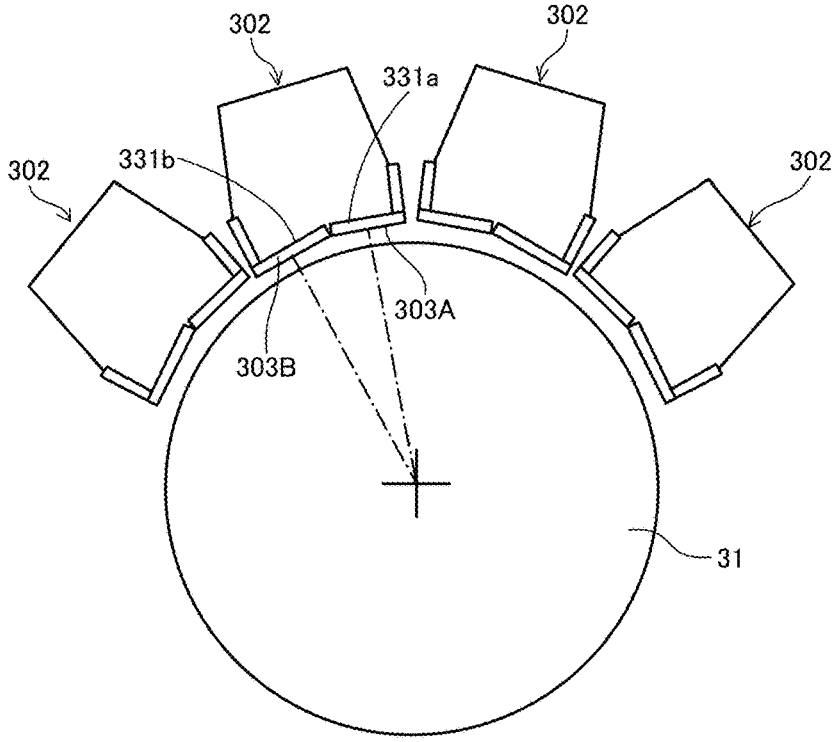
FIG. 8 is a front view of the head mount illustrating an arrangement of the head mount with respect to a drum.

FIG. 8 is a front view of the head mount 302 illustrating an arrangement of the head mount 302 with respect to the drum 31.

The head mount 302 includes two bases 303 (303A and 303B). Multiple openings 304 are formed in each of two bases 303, and the heads 100 are respectively inserted into the multiple openings 304. The bases 303A and 303B are formed of two plate materials (boards). The bases 303A and 303B are fixed to intermediate side plates 306 (306*a* and 306*b*) and are further fixed to the side plates 305 (305*a* and 305*b*) outside the intermediate side plates 306 (306*a* and 306*b*).

As illustrated in FIG. 8, a mounting surface 331 (331*a* and 331*b*) of each of the bases 303A and 303B of the head mount 302 is disposed in a direction parallel to a tangential direction of the drum 31.

The head mount 302 according to the first embodiment of the present disclosure is described with reference to FIGS. 9 to 11.

Figure 9:
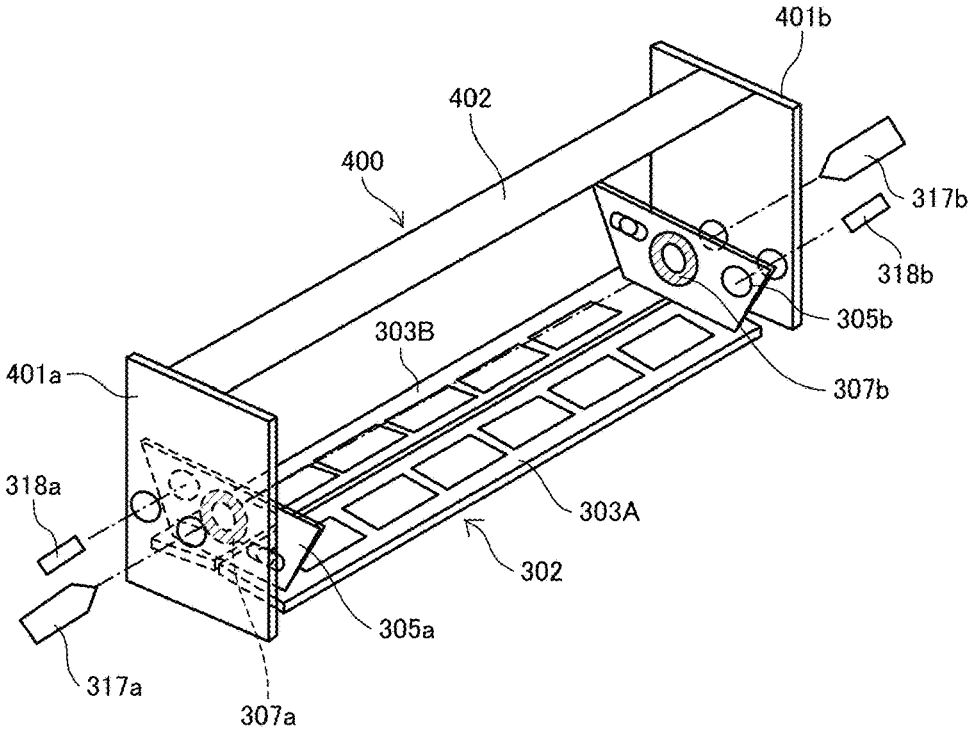
FIG. 9 is a schematic perspective view of the head mount and a holder according to the first embodiment of the present disclosure.

FIG. 9 is a schematic perspective view of the head mount 302 and a holder 400 according to the first embodiment of the present disclosure.

Figure 10:
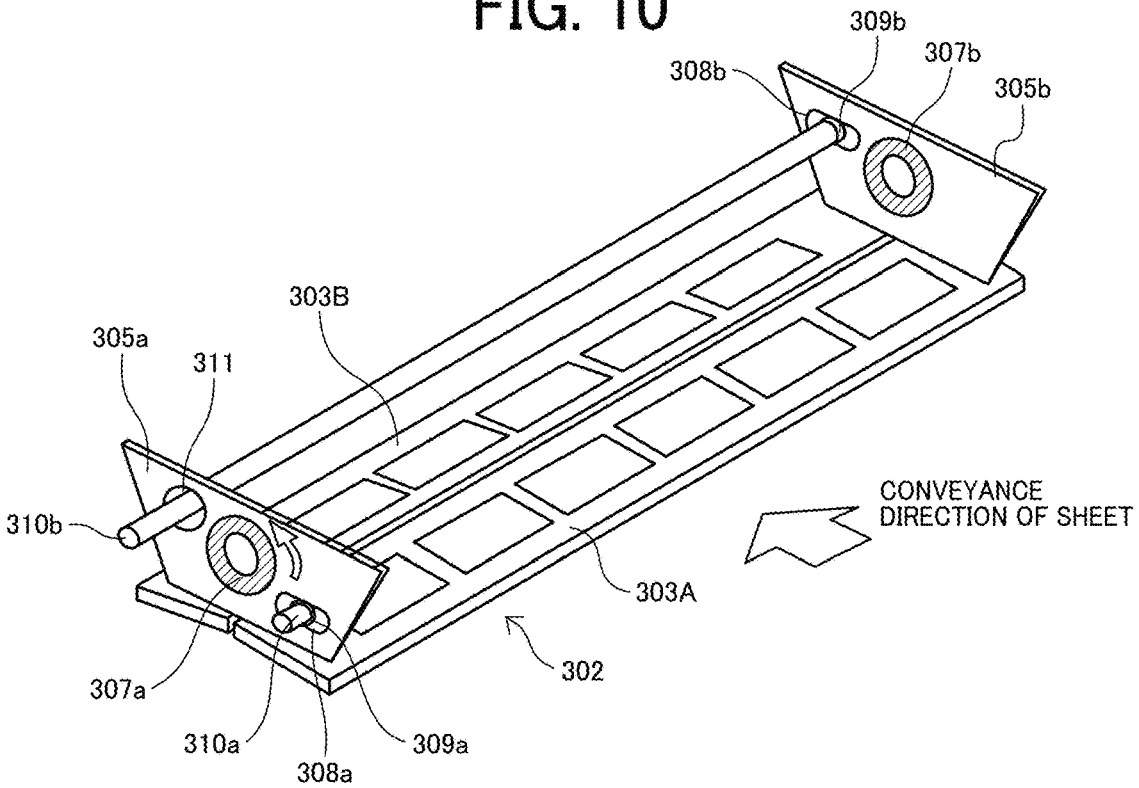
FIG. 10 is a schematic perspective view of the head mount according to the first embodiment of the present disclosure.

FIG. 10 is a schematic perspective view of the head mount 302 according to the first embodiment of the present disclosure.

Figure 11:
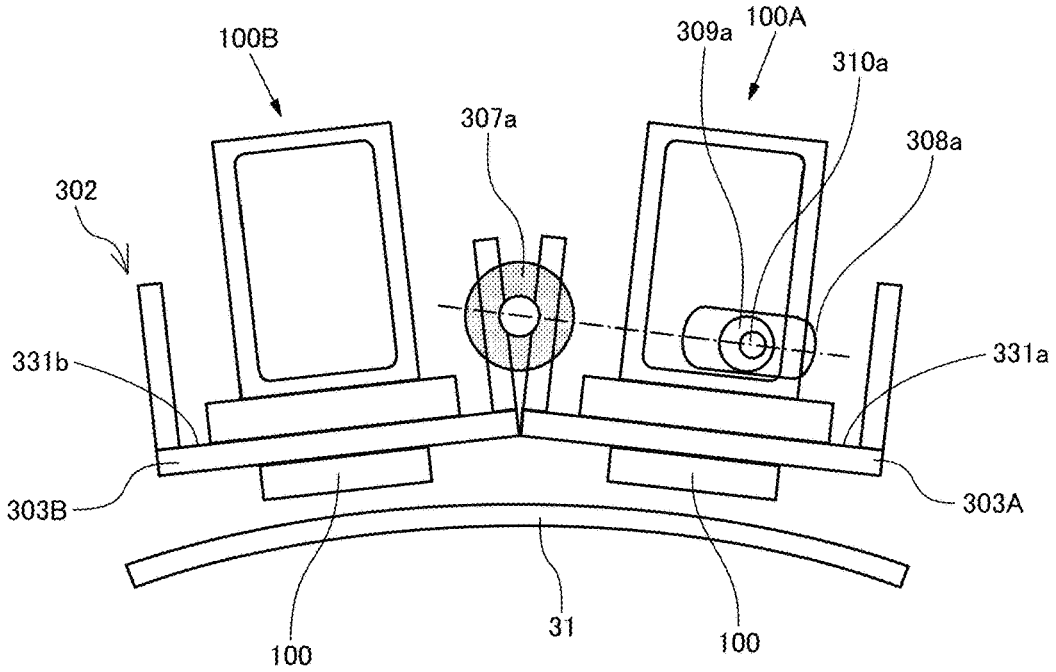
FIG. 11 is a schematic cross-sectional front view of the head mount according to the first embodiment of the present disclosure.

FIG. 11 is a schematic cross-sectional front view of the head mount 302 according to the first embodiment of the present disclosure.

The discharge unit 33 includes the holder 400 that holds both ends of the head mount 302 in a longitudinal direction of the head mount 302. The longitudinal direction of the head mount 302 is parallel to a nozzle array direction of the head 100 along which the nozzles 104 are arrayed in the nozzle array of the head 100. The longitudinal direction of the head mount 302 intersects the conveyance direction of the sheet P onto which a liquid is discharged from the head 100.

The holder 400 includes two holding parts 401 (401*a* and 401*b*) that respectively hold side plates 305 (305*a* and 305*b*) of the head mount 302 at both ends in the longitudinal direction of the head mount 302. The two holding parts 401 are connected by a connector 402 and fixed to an apparatus body of the printing unit 30.

The rotation mechanism 307 independently and rotatably holds the side plates 305 of the head mount 302 with respect to the holding part 401. The side plates 305 are disposed at each ends of the head mount in the longitudinal direction of the head mount 302. The head mount 302 in the first embodiment is disposed such that the side plate 305*a* is on a front side of the printer 1 and the side plate 305*b* is on a rear side of the printer 1.

Thus, the discharge unit 33 includes a head 100 configured to discharge a liquid, the head mount 302 to which the head is detachably attachable, and the holder 400 configured to hold the head mount 302. The head mount 302 includes multiple rotation mechanisms 307 on multiple portions (both ends in FIG. 10) of the head mount 302 in a longitudinal direction of the head mount 302, and the holder 400 is configured to rotatably and independently hold the multiple portions of the head mount 302 with the rotation mechanisms 307.

The rotation mechanism 307 includes detachable rotation shafts 317 (317*a* and 317*b*). The rotation shaft 317 of the rotation mechanism 307 is removed to make the head mount 302 detachably attachable to the holding part 401.

Figure 12A:
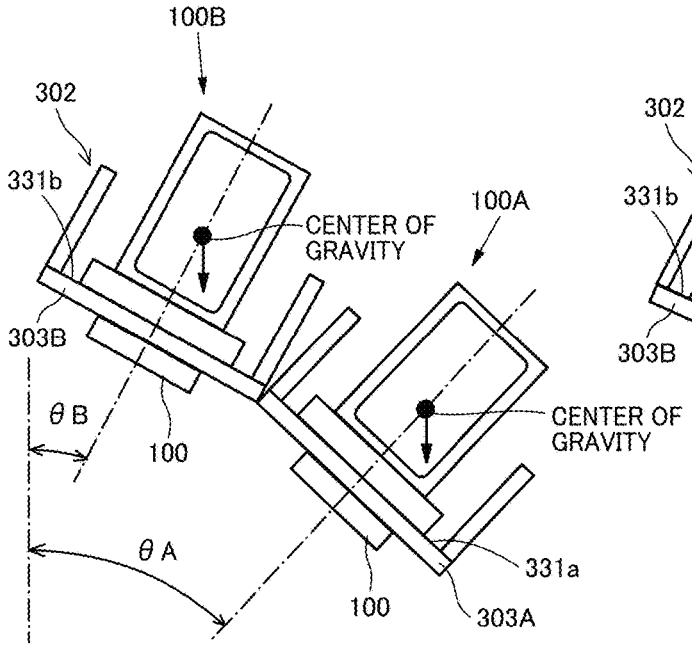
FIGS. 12A and 12B are schematic front views of the head mount according to the first embodiment to illustrate a deformation of a base.

As illustrated in FIG. 11 and FIGS. 12A and 2B, the rotation mechanism 307 is disposed at a center of the head mount 302 in a transverse direction of the head mount 302. The head mount 302 respectively includes elongated holes 308 (308*a* and 308*b*) in the side plate 305*a* and 305*b* to rotate the rotation mechanism 307. The head mount 302 further includes eccentric cams 309 (309*a* and 309*b*) respectively engaging with the elongated holes 308. The eccentric cam 309 is attached to an operation part 310 (310*a* and 310*b*).

Thus, the eccentric cam 309 is rotated to rotate the rotation mechanism 307 so that the head mount 302 is rotated with respect to the holding part 401. After a position of the head mount 302 is adjusted with respect to the holding part 401, the head mount 302 is fixed to the holding part 401 by the fixing member 318 (318*a* and 318*b*). A fastening member such as a screw can be used as the fixing member 318, for example.

The head mount 302 in the first embodiment includes rotation mechanisms 307*a* and 307*b* on a front side plate 305*a* and a rear side plate 305*b*, respectively. The head mount 302 is rotatably held by the holder 400 such that the front side plate 305*a* and the rear side plate 305*b* are independently and rotatably held by the holding parts 401*a* and 401*b*, respectively.

Accordingly, even when the head mount 302 is twisted with respected to the holder 400 in a front end and a rear end of the head mount 302 in the longitudinal direction of the head mount 302, the front side plate 305*a* and the rear side plate 305*b* are rotated relative to the holding parts 401*a* and 401*b* of the holder 400 to reduce the twist. The twist between the front end and the rear end of the head mount 302 are a twist between one end and another end of the head mount 302 in the longitudinal direction of the head mount 302.

The head mount 302 in the first embodiment respectively includes the rotation mechanisms 307*a* and 307*b* on the front side plate 305*a* and the rear side plate 305*b*. As illustrated in FIG. 10, the operation part 310*b* of the eccentric cam 309*b* passes through a hole 311 in the front side plate 305*a* and is drawn out to the front side (left side in FIG. 10) of the front side plate 305*a*. The operation part 310*b* rotates a rear side of the rotation mechanism 307*b*. The operation part 310*b* passes through the elongated hole 308*b* in the rear side plate 305*b* and the hole 311 in the front side plate 305*a*. In FIG. 10, the operation part 310*b* is a bar that has a length longer than a length between the front side plate 305*a* and the rear side plate 305*b*.

Accordingly, the user can access the rear side (another end) of the rotation mechanism 307*b* from the front side (one end) of the head mount 302. Thus, the discharge unit 33 according to the first embodiment can improve a workability of a rotation operation of the head mount 302 by the rotation mechanism 307.

Next, an effect of the head mount 302 according to the first embodiment is described more specifically below with reference to FIGS. 12 to 16.

First, deformation of the base member (head mounting surface) of the mounting member in the lateral direction will be described with reference to FIGS. 12A and 12B.

Figure 12B:
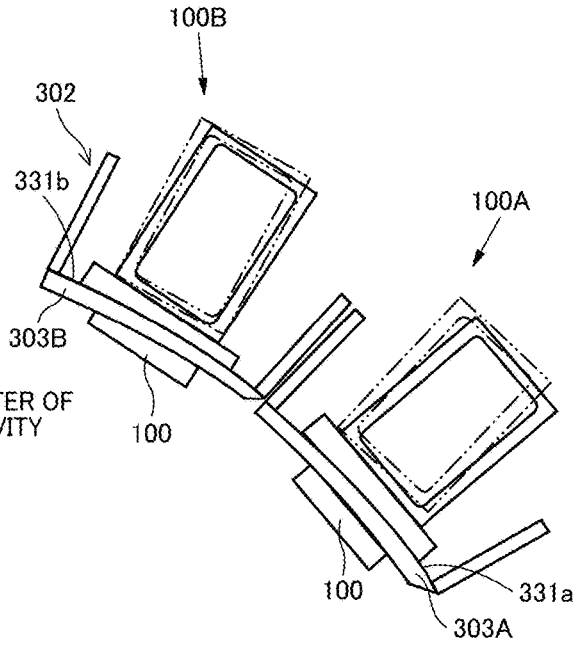

FIGS. 12A and 12B are schematic front views of the head mount 302 according to the first embodiment to illustrate the deformation of the bases 303.

The head mount 302 is disposed to be inclined around the drum 31. Each head 100 in the head rows 100A and 100B attached to the two bases 303A and 303B has an inclination angle for each row. That is, the head 100 in the head row 100A and the head 100 in the head row 100B have different inclination angles.

As illustrated in FIG. 12A, an upstream side (right side) of the head rows 100A and 100B is referred to as the head row 100A, and a downstream side (left side) of the head rows 100A and 100B is referred to as the head row 100B in the conveyance direction of the sheet P of the drum 31, for example. The inclination angle θA of the head 100 in the head row 100A and the inclination angle θB of the head 100 in the head row 100B have a relation of θA>θB. That is, the inclination angle of the head row 100A, disposed lower than the head row 100B, is larger than the inclination angle of the head row 100B in an inclination direction indicated by arrow in FIG. 12A from a vertical line indicated by a dash-single dot line.

The head 100 has a center of gravity, and a load is applied to the lower side of the head 100 in a gravity direction. Further, there is a difference in a number of heads 100 between the head row 100A and the head row 100B in the first embodiment. That is, the number of heads 100 in the head row 100A is different from the number of heads 100 in the head row 100B.

Because of the above reasons, the mounting surface 331 (base 303) of the head mount 302 deforms. Thus, each of the heads 100 of the head row 100A and the head row 100B takes a posture indicated by a solid line in an actual attached state with respect to a designed posture indicated by a broken line in FIG. 12B, for example.

Further, an amount of deformation differs between the mounting surface 331*a* (base 303A) and the mounting surface 331*b* (base 303B) of the head mount 302.

Next, a deformation of the base 303 (mounting surface 331) of the head mount 302 in the longitudinal direction of the head mount 302 is described below with reference to FIG. 13.

Figure 13:
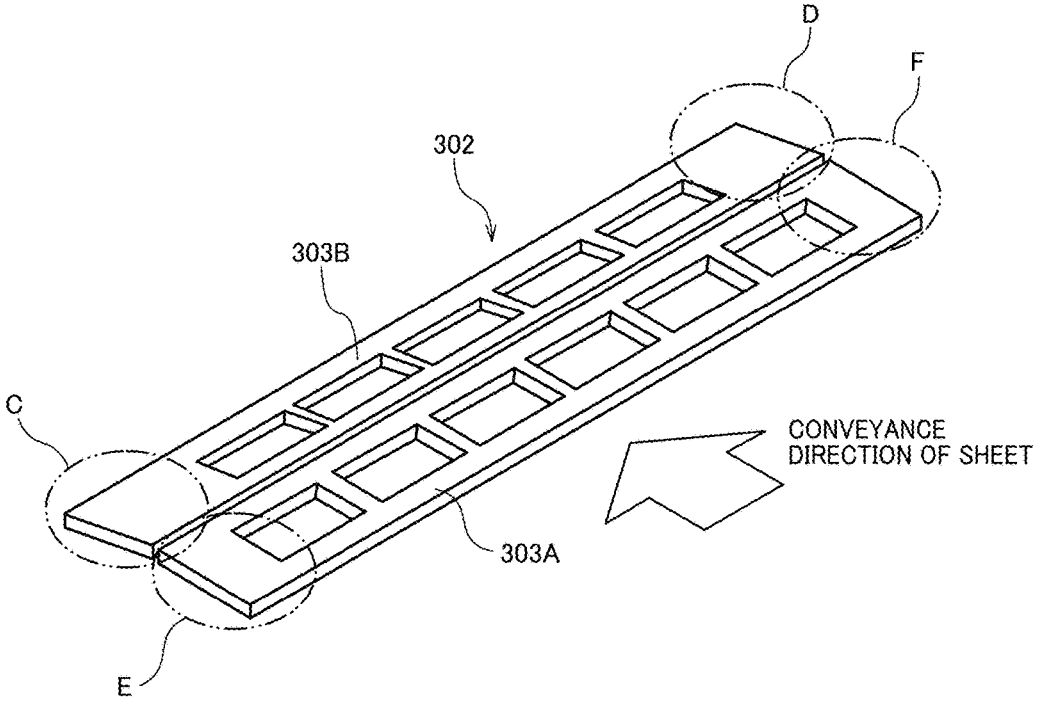
FIG. 13 is an enlarged partial perspective view of a base (mounting surface) illustrating the deformation of the base.

FIG. 13 is an enlarged partial perspective view of the base 303 (mounting surface 331) illustrating the deformation of the base 303.

A processing accuracy of the head mount 302 and a position of the center of gravity of the head 100 are not identical at both ends (front end and rear end of the head mount 302) in the longitudinal direction of the head mount 302.

Therefore, the amount of deformation may differ between a front end "C" and a rear end "D" of the base 303B of the head mount 302 in the longitudinal direction of the base 303B of the head mount 302. Similarly, the amount of deformation may be different between a front end "E" and a rear end "F" of the base 303A of the head mount 302 in the longitudinal direction of the base 303A of the head mount 302. Thus, the base 303 is twisted in the longitudinal direction of the head mount 302.

Next, influence of the deformation of the base 303 (mounting surface 331) of the head mount 302 on a landing timing of the liquid onto the sheet P borne on the drum 31 is described below with reference to FIG. 14.

Figure 14:
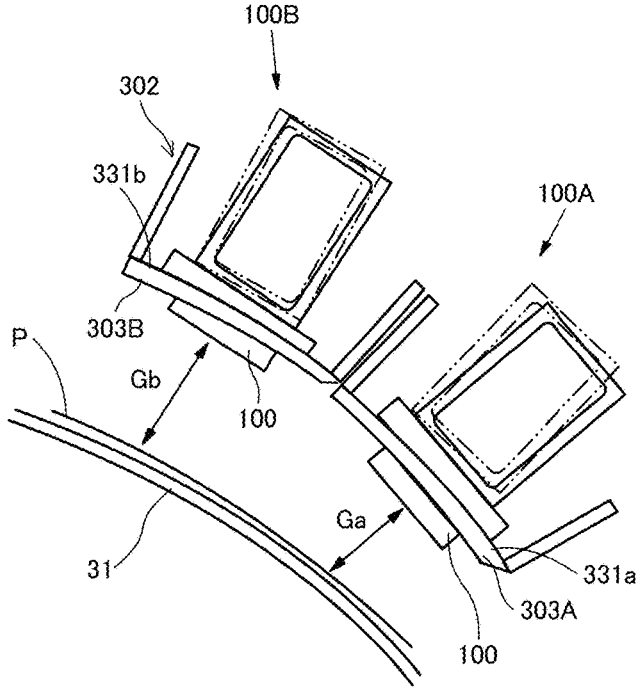
FIG. 14 is a schematic front view of the head mount according to the first embodiment to illustrate the deformation of the base.

FIG. 14 is a schematic front view of the head mount 302 according to the first embodiment to illustrate the deformation of the bases 303.

Figure 15A:
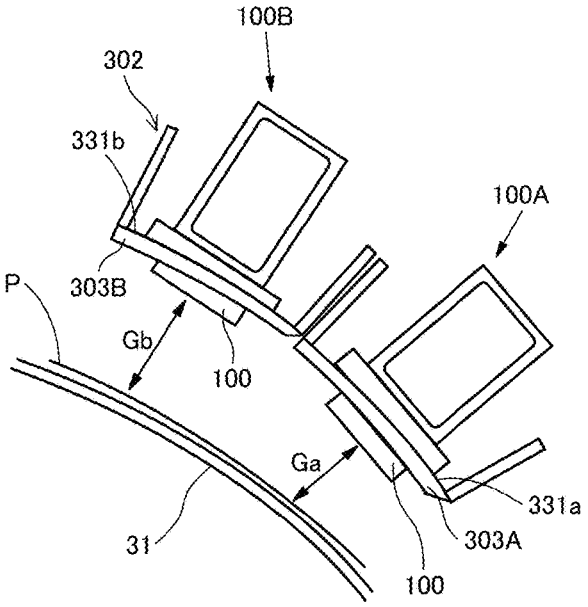
FIGS. 15A and 15B are schematic cross-sectional front views of the discharge unit illustrating a gap adjustment of the discharge unit.
Figure 15B:
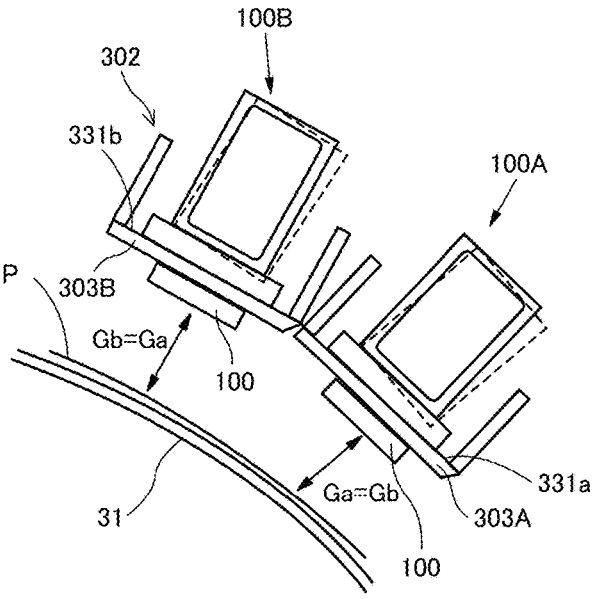

The amount of deformation of the mounting surface 331*a* of the base 303A is different from the amount of deformation of the mounting surface 331*b* of the base 303B as illustrated in FIG. 15B. Thus, a gap Ga between the head 100 of the head row 100A and a circumferential surface of the drum 31 and a gap Gb between the head 100 of the head row 100B and the circumferential surface of the drum 31 are different.

Since the gap Ga and the gap Gb are different from each other, the discharge timing of the liquid is different between the head row 100A and the head row 100B. A discharge timing described herein means a discharge timing in a state in which there is no positional deviation between the head row 100A and the head row 100B in the conveyance direction of the sheet P.

An operation of a gap adjustment of the discharge unit 33 according to the first embodiment is described below with reference to FIGS. 15A and 15B.

FIGS. 15A and 15B are schematic cross-sectional front views of the discharge unit 33 illustrating the gap adjustment of the discharge unit 33.

As illustrated in FIGS. 15A and 15B, it is assumed that the amount of deformation is different between the base 303A and the base 303B of the head mount 302, and it is assumed that the gap Ga of the head row 100A is different from the gap Gb of the head row 100B.

In the above state, the head mount 302 is rotated with respect to the holding part 401 by the rotation mechanism 307 to adjust the gap Ga of the head row 100A to be equal to the gap Gb of the head row 100B (Ga=Gb) as illustrated in FIG. 15B.

Therefore, the head mount 302 is fixed to the holding part 401 by the fixing member 318 after a position of the head mount 302 is adjusted with respect to the holding part 401.

The rotation mechanism 307 can adjust and match the discharge timings of the heads 100 in the head row 100A and the head row 100B.

As described above, the discharge unit 33 according to the first embodiment includes the rotation mechanisms 307*a* and 307*b* on the front side plate 305*a* and the rear side plate 305*b* of the head mount 302, respectively, as illustrated in FIG. 10. The holding part 401 independently and rotatably hold the side plates 305*a* and 305*b* as illustrated in FIG. 9.

The front side plate 305*a* and the rear side plate 305*b* are relatively rotatable in opposite directions with respect to the holding parts 401*a* and 401*b* to reduce a twist occurred in the longitudinal direction of the head mount 302 (between one end and another end of the head mount 302). Thus, the discharge unit 33 according to the first embodiment can reduce the twist and adjust the gaps Ga and Gb (see FIGS. 15A and 15B) in the longitudinal direction of the head mount 302.

Next, another operational effect of the discharge unit 33 according to the first embodiment is described below with reference to FIG. 16.

Figure 16:
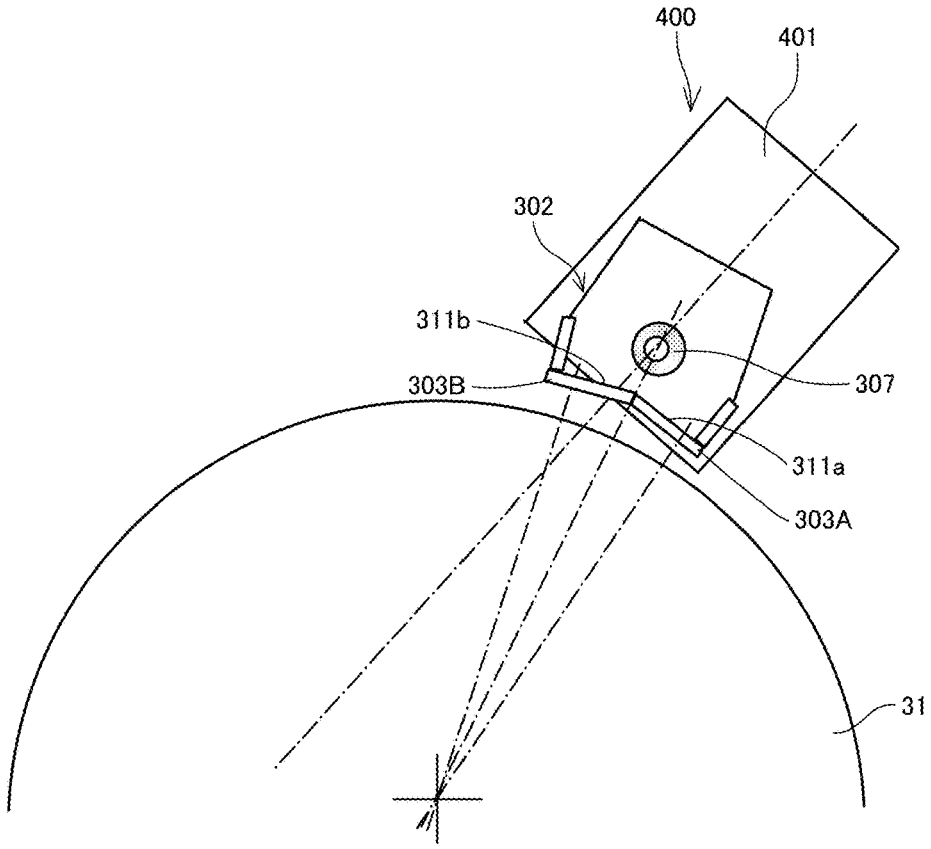
FIG. 16 is a schematic cross-sectional front view of the discharge unit illustrating an operational effect of the discharge unit.

FIG. 16 is a schematic cross-sectional front view of the discharge unit 33 illustrating the operational effect of the discharge unit 33.

In the discharge unit 33 according to the first embodiment, the holding part 401 rotatably holds the head mount 302 by the rotation mechanism 307.

Thus, the discharge unit 33 can adjust the base 303 of the head mount 302 to face a center (rotation axis) of the drum 31 even when the holder 400 does not face the center of the drum 31 as illustrated in FIG. 16.

Next, the discharge unit 33 according to a second embodiment of the present disclosure is described with reference to FIG. 17.

Figure 17:
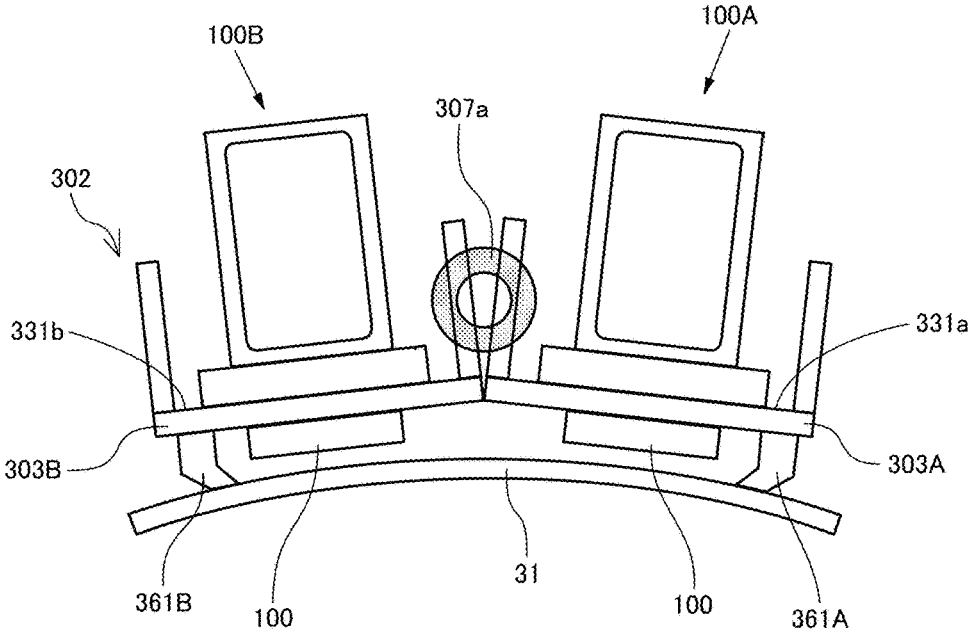
FIG. 17 is a schematic front view of the discharge unit according to a second embodiment of the present disclosure.

FIG. 17 is a schematic front view of the discharge unit 33 according to the second embodiment of the present disclosure.

The discharge unit 33 in the second embodiment includes gap defining members 361A and 361B (abutment members) at an upstream end and a downstream end of the head mount 302 in the conveyance direction of the sheet P.

The head mount 302 is free to rotate by the rotation mechanism 307 (rotation mechanism 307*a* is illustrated in FIG. 17).

Therefore, the head mount 302 is held by the holding part 401 in a state in which both of the gap defining members 361A and 361B abut against (contact with) a circumferential surface of the drum 31.

Thus, the gap defining members 361A, 361B abut against a circumferential surface of the drum 31, and the gap defining members 361A, and 361B are configured to define a gap between the head 100 and the drum 31.

Since the gaps Ga and Gb (see FIGS. 15A and 15B) between the head rows 100A and 100B and the drum 31 becomes an appropriate posture, the head mount 302 is fixed to the holding part 401 in this appropriated posture.

The head mount 302 includes the gap defining members 361A and 361E arranged in a front side and a rear side of the head mount 302 corresponding to the front side and rear side of the rotation mechanisms 307*a* and 307*b*. Alternatively, the head mount 302 may include the gap defining members 361A and 361B arranged over the longitudinal direction of the head mount 302. That is, the gap defining members 361A and 361B extends in the longitudinal direction of the head mount 302.

Thus, the head mount 302 can be fixed to the holder 400 in a posture with reduced torsion (twist) even when the head mount 302 is twisted.

Next, the discharge unit 33 according to a third embodiment of the present disclosure is described with reference to FIG. 18.

Figure 18:
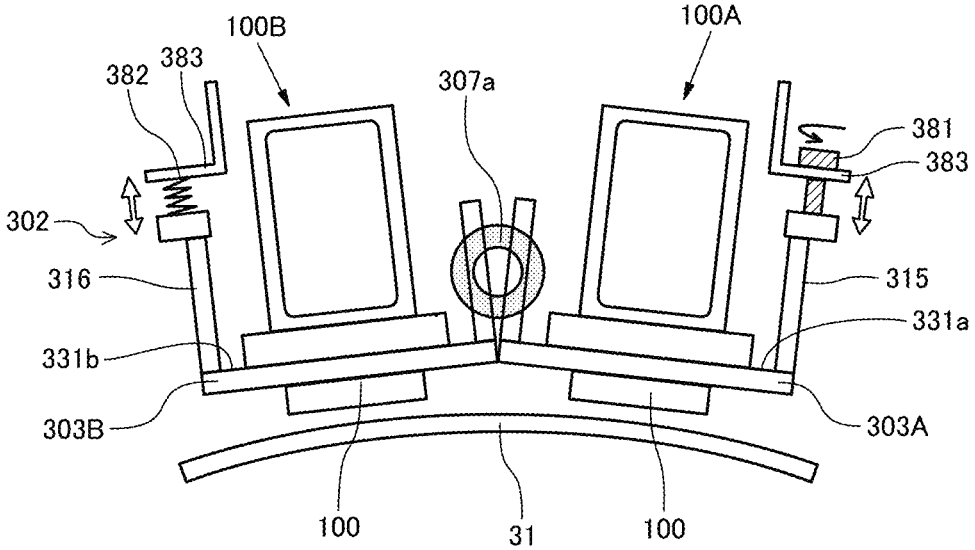
FIG. 18 is a schematic front view of the discharge unit according to a third embodiment of the present disclosure.

FIG. 18 is a schematic front view of the discharge unit 33 according to the third embodiment of the present disclosure.

The discharge unit 33 according to the third embodiment includes a screw 381 on an upper part of an upstream side wall 315 of the base 303A of the head mount 302 and a spring 382 on an upper part of a downstream side wall 316 of the base 303B.

The screw 381 is attached to the fixing part 383 as indicated by arrow in FIG. 18 so that the screw 381 can advance toward and retract from the fixing part 383. A leading end of the screw 381 is in contact with an upper end of the upstream side wall 315. The spring 382 is disposed between the upper end of the downstream side wall 316 and the fixing part 383. The spring 382 biases the downstream side wall 316 downward.

When the screw 381 is loosened, the head mount 302 is rotated by a restoring force of the springs 382 via the rotation mechanism 307 so that the gap between the head row 100A on the base 303A and the circumferential surface of the drum 31 increases.

When the screw 381 is tightened, the head mount 302 rotates in a direction in which the base 303A approaches the drum 31 via the rotation mechanism 307 so that the gap between the head row 100B on the base 303B and the circumferential surface of the drum 31 increases.

The discharge unit 33 includes the screw 381 and the spring 382 respectively corresponding to the front rotation mechanism 307*a* and the rear rotation mechanism 307*b*. Thus, the head mount 302 can be fixed to the holder 400 in a posture with reduced torsion (twist) even when the head mount 302 is twisted.

Next, the discharge unit 33 according to a fourth embodiment of the present disclosure is described with reference to FIG. 19.

Figure 19:
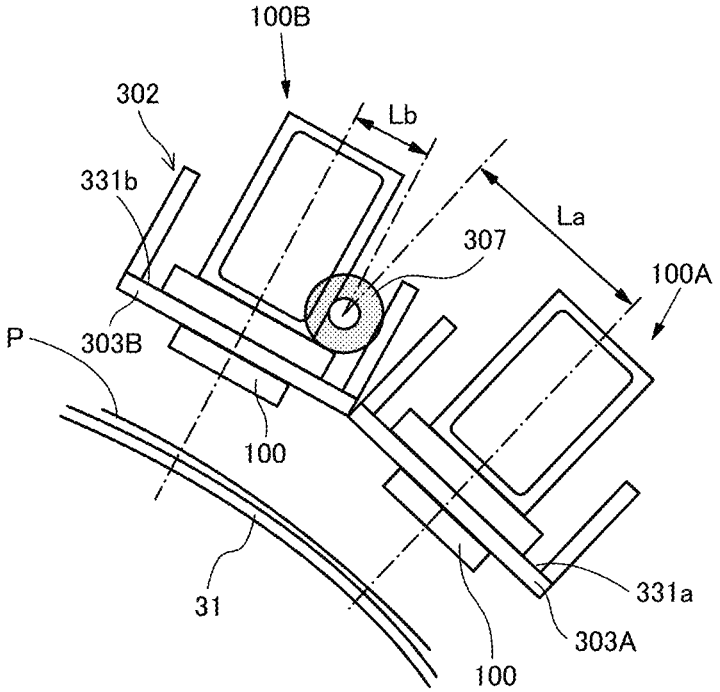
FIG. 19 is a schematic front view of the discharge unit according to a fourth embodiment of the present disclosure.

FIG. 19 is a schematic front view of the discharge unit 33 according to the fourth embodiment of the present disclosure.

The discharge unit 33 in the fourth embodiment includes the rotation mechanism 307 at a position other than a center portion of the head mount 302 in a transverse direction of the head mount 302. The position other than the center portion of the head mount is a position deviated from the center portion of the head mount 302. The transverse direction is in the conveyance direction of the sheet P.

In FIG. 19, the rotation mechanism 307 is disposed at a position away from the center of the base 303A by a distance "La" in the transverse direction of the head mount 302 and away from the center of the base 303B by a distance "Lb" in the transverse direction of the head mount 302.

Thus, an amount of adjustment of the position of the head mount 302 according to a rotation of the rotation mechanism 307 is different for each of the head rows 100A and 100B. The discharge unit 33 in the fourth embodiment includes the rotation mechanism 307 biased toward the base 303B (Lb<La). Thus, the amount of adjustment of the position of the head mount 302 due to a rotation of the head mount 302 in the base 303A is larger the amount of adjustment of the position of the head mount 302 due to a rotation of the head mount 302 in the base 303B.

The discharge unit 33 in the fourth embodiment includes the rotation mechanism 307 at an optimum position according to the amount of deformation of the base 303 (mounting surface 331) of the head mount 302 and the amount of adjustment of the gaps Ga and Gb for the head rows 100A and 100B so that the discharge unit 33 can adjust the position of the head mount 302 with a small amount of rotation of the rotation mechanism 307.

Next, the discharge unit 33 according to a fifth embodiment of the present disclosure is described with reference to FIG. 20.

Figure 20:
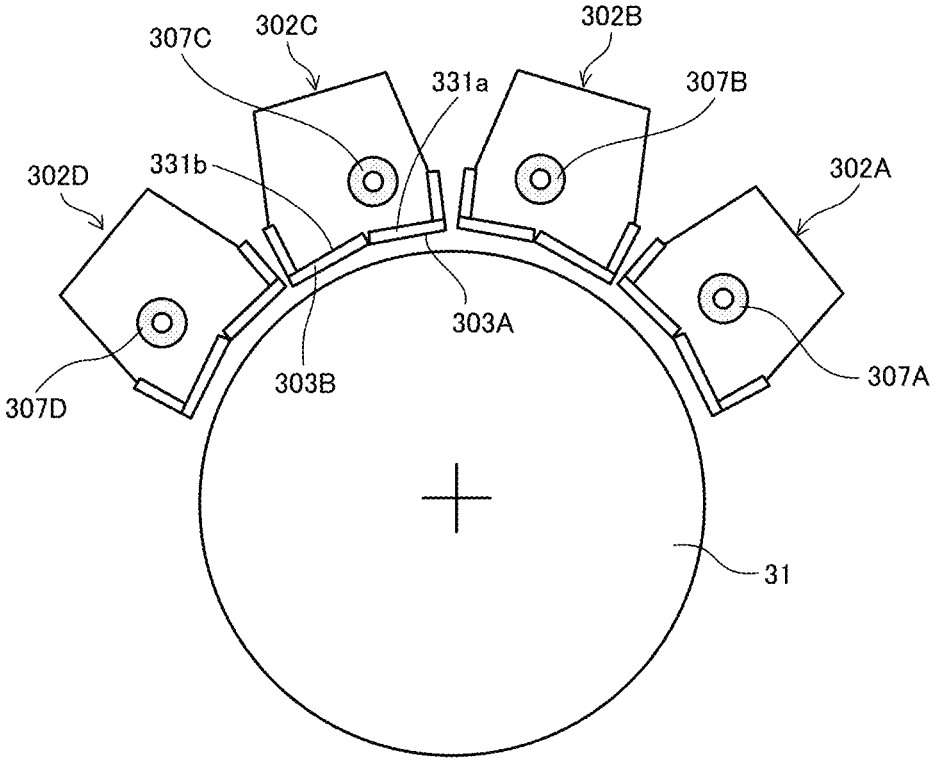
FIG. 20 is a schematic front view of the discharge unit according to a fifth embodiment of the present disclosure.

FIG. 20 is a schematic front view of the discharge unit 33 according to the fifth embodiment of the present disclosure.

The discharge unit 33 in the fifth embodiment includes multiple head mounts 302 (302A to 302D) to respectively dispose multiple discharge units 33A to 33D around the drum 31 (see FIG. 1).

As described above, amounts of deformation of the base 303 (mounting surfaces 331) of the multiple head mounts 302 (302A to 302D) are different. Therefore, the rotation mechanisms 307A to 307D of the multiple head mounts 302 (302A to 302D) are disposed at positions at which the amounts of deformation can be reduced in accordance with the amount of deformation of each of the head mounts 302 (302A to 302D).

That is, the discharge unit 33 in the fifth embodiment includes the multiple head mounts 302, and positions of rotation fulcrums (centers of axis) of at least two head mounts 302 among the multiple head mounts 302 are different from each other.

Thus, the discharge unit 33 having the above configuration can perform appropriate adjustment according to the amount of deformation of the head mount 302.

Thus, the head mount 302 includes at least two head mounts 302, and said at least two head mounts 302 respectively include at least two rotation fulcrums disposed at different positions in said at least two head mounts 302.

The above-described embodiments describe examples in which the head mount 302 includes the multiple head rows 100A and 100B, each including multiple heads 100. However, the present invention may be applied to the head mount including one head 100.

The liquid discharge apparatus according to the present invention can reduce torsion of the attachment to which the head is attached.

In the present embodiments, a "liquid" discharged from the head is not particularly limited as long as the liquid has a viscosity and surface tension of degrees dischargeable from the head.

Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials to which liquid can adhere, but also apparatuses to discharge a liquid toward gas or into a liquid.

The "liquid discharge apparatus" may include units to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures.

For example, the liquid discharge apparatus may be an apparatus to form arbitrary images, such as arbitrary patterns, or fabricate three-dimensional images.

The above-described term "material on which liquid can adhere" represents a material on which liquid is at least temporarily adhered, a material on which liquid is adhered and fixed, or a material into which liquid is adhered to permeate.

Examples of the "material on which liquid can adhere" include recording media such as a paper sheet, recording paper, and a recording sheet of paper, film, and cloth, electronic components such as an electronic substrate and a piezoelectric element, and media such as a powder layer, an organ model, and a testing cell.

The "material on which liquid can adhere" includes any material on which liquid adheres unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere.

However, the liquid discharge apparatus is not limited to such an apparatus.

For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A discharge unit comprising:

a head to discharge a liquid;

a head mount to which the head is detachably attached, the head mount including two bases forming an angle in a traverse direction of the head mount, and a front side plate and a rear side plate at both ends in a longitudinal direction of the head mount respectively; and a holder holding the head mount, wherein the head mount includes multiple rotation structures on the front side plate and the rear side plate of the head mount in the longitudinal direction of the head mount respectively, the holder rotatably and independently holds the front side plate and the rear side plate of the head mount with the respective rotation structures, each of the rotation structures includes a rotation shaft inserted into a hole on the front side plate or the rear side plate of the head mount, and the front side plate and the rear side plate are rotatable independently from each other with respect to the holder.

2. The discharge unit according to claim 1, wherein the longitudinal direction of the head mount intersects a conveyance direction of an application target onto which the liquid is discharged from the head.

3. The discharge unit according to claim 1, wherein the head includes multiple heads, and the multiple heads are attached to the head mount in the transverse direction orthogonal to the longitudinal direction.

4. The discharge unit according to claim 1, wherein the head mount includes an eccentric cam to rotate the head mount.

5. The discharge unit according to claim 1, wherein the holder rotatably holds the both ends of the head mount in the longitudinal direction of the head mount, and the head mount includes an operation structure to rotate one end of the head mount from another end of the head mount in the longitudinal direction of the head mount.

6. The discharge unit according to claim 5, wherein the head mount includes an eccentric cam to rotate the head mount, and the eccentric cam is attached to the operation structure.

7. The discharge unit according to claim 1,
wherein the holder rotatably holds the head mount at a center of the head mount in the transverse direction orthogonal to the longitudinal direction.

8. The discharge unit according to claim 1,
wherein each of the multiple rotation structures is at a position deviated from a center of the head mount in the transverse direction orthogonal to the longitudinal direction.

9. The discharge unit according to claim 1,
wherein the head mount is detachably attached to the holder.

10. The discharge unit according to claim 1,
wherein the head mount includes multiple head mounts, and
at least two of the multiple head mounts respectively include at least two rotation fulcrums disposed at different positions with respect to corresponding said at least two of the multiple head mounts.

11. A liquid discharge apparatus comprising:
the discharge unit according to claim 1; and
a drum facing the discharge unit, the drum configured to bear a sheet and rotate to convey the sheet.

12. The liquid discharge apparatus according to claim 11,
further comprising a gap defining structure to abut against a circumferential surface of the drum to define a gap between the head and the drum.

* * * * *